US009739474B2

(12) United States Patent
Heinesen et al.

(10) Patent No.: US 9,739,474 B2
(45) Date of Patent: Aug. 22, 2017

(54) WASTE HEAT BOILER WITH BYPASS AND MIXER

(75) Inventors: Søren Heinesen, Copenhagen (DK); Michael Boe, Klampenborg (DK)

(73) Assignee: Haldor Topsoe A/S, Lyngby (DK)

( * ) Notice: Subject to any disclaimer, the term of this patent is extended or adjusted under 35 U.S.C. 154(b) by 61 days.

(21) Appl. No.: 14/399,618

(22) PCT Filed: May 9, 2012

(86) PCT No.: PCT/EP2012/058536

§ 371 (c)(1),
(2), (4) Date: Jan. 26, 2015

(87) PCT Pub. No.: WO2013/167180

PCT Pub. Date: Nov. 14, 2013

(65) Prior Publication Data

US 2015/0159861 A1 Jun. 11, 2015

(51) Int. Cl.

| | |
|---|---|
| ***F22B 1/18*** | (2006.01) |
| ***B01F 5/04*** | (2006.01) |
| ***B01F 3/02*** | (2006.01) |
| ***F22B 35/00*** | (2006.01) |
| ***F28F 13/12*** | (2006.01) |
| ***F28F 27/02*** | (2006.01) |
| ***F28D 7/16*** | (2006.01) |
| ***F28D 21/00*** | (2006.01) |
| *B01F 5/00* | (2006.01) |

(52) U.S. Cl.

CPC ..... *F22B 1/18* (2013.01); *B01F 3/02* (2013.01); *B01F 5/0463* (2013.01); *F22B 1/1884* (2013.01); *F22B 35/007* (2013.01); *F28D 7/1669* (2013.01); *F28D 21/001* (2013.01); *F28F 13/12* (2013.01); *F28F 27/02* (2013.01); *B01F 2005/0017* (2013.01); *F28F 2250/06* (2013.01)

(58) Field of Classification Search

USPC ..... 122/7 R; 60/320

See application file for complete search history.

(56) References Cited

U.S. PATENT DOCUMENTS

| | | | | |
|---|---|---|---|---|
| 3,604,400 | A * | 9/1971 | Sharan | F23C 6/02 122/235.11 |
| 5,452,686 | A | 9/1995 | Stahl | |
| 5,766,451 | A * | 6/1998 | Sparling | B01D 35/153 123/196 A |
| 6,375,155 | B1 * | 4/2002 | Janssens | F16L 55/10 251/212 |

(Continued)

FOREIGN PATENT DOCUMENTS

| | | |
|---|---|---|
| CN | 1982802 A | 6/2007 |
| CN | 2014-01771 Y | 2/2010 |
| DE | 10 2010 048 626 A1 | 4/2012 |

(Continued)

*Primary Examiner* — Alissa Tompkins
*Assistant Examiner* — John Bargero
(74) *Attorney, Agent, or Firm* — Blank Rome LLP

(57) ABSTRACT

A waste heat boiler has heat exchange tubes for indirect heat exchange of a relatively hot process gas and a cooling media, and a by-pass tube for by-passing a part of the process gas; a swirl mixer ensures mixing of the cooled process gas and the relative hot process gas exiting the heat exchange tubes and the by-pass tube.

8 Claims, 2 Drawing Sheets

(56) References Cited

U.S. PATENT DOCUMENTS

| | | | | |
|---|---|---|---|---|
| 6,718,956 | B2 * | 4/2004 | Klipfel | F02M 25/0728 123/568.12 |
| 2011/0131961 | A1 * | 6/2011 | Lee | F01M 5/001 60/320 |

FOREIGN PATENT DOCUMENTS

| | | | |
|---|---|---|---|
| EP | 0 357 907 | A1 | 3/1990 |
| GB | 1 303 092 | A | 1/1973 |
| GB | 2133527 | A | 7/1984 |
| WO | WO 2012/041344 | A1 | 4/2012 |

* cited by examiner

WASTE HEAT BOILER WITH BYPASS AND MIXER

BACKGROUND OF THE INVENTION

1. Field of the Invention

The present invention is directed to the recovery of waste heat from chemical reactions. More particularly, the invention relates to a waste heat boiler with improved mixing of the gas streams exiting the waste heat boiler.

2. Description of the Related Art

Waste heat boilers are most generally used for the generation of steam by waste heat recovered from hot process streams. Typically, those boilers are designed as shell-and-tube exchangers with a plurality of heat exchanging tubes arranged within a cylindrical shell.

Two basic types of shell-and-tube exchangers are employed in the industry, the water-tube type, in which water/steam mixtures flow through the tubes, and the fire-tube type having the heating process stream inside the tubes.

The characteristic components of the boiler are the tubes mounted in tube sheets at a front-end head and a rear-end head within the shell. In the fire-tube boilers steam production is accomplished on the shell side of the tubes by indirect heat exchange of a hot process stream flowing through the boiler tubes. The shell side is through a number of risers and down-comers connected to a steam drum, which may be arranged above or as an integral part of the boiler shell.

The mechanical design and, in particular, dimensioning of the heat exchanging surface in shell-and-tube exchanger type boilers represent certain problems. Fire-tube boiler applications involve high pressures on the shell side or on both sides, and considerable temperature differences between the shell side and the tube side. Particular considerations have to be given to fouling and corrosion characteristics of the process stream.

Boilers handling fouling and/or corrosive process streams must be designed to a higher duty than required when clean in order to allow for satisfying lifetime under serious fouling and/or corroding conditions. The heat exchanging surface of the boiler tubes has further to be adapted to expected corrosion and fouling factors in the stream. To provide for a desired and substantially constant cooling effect during long term operation of the boilers, appropriate heat exchange and temperature control is required.

Conventionally designed boilers are equipped with a by-pass of a relative large diameter tube (relative to the heat exchange tube diameter), which may be internal or external to the boiler shell. The by-pass is usually constructed as an insulated tube provided with a flow control valve. During initial operation of the boilers, part of the hot process stream is by-passed the heat exchanging tubes to limit the heat exchange within the required level.

After a certain time, on stream fouling and/or corrosion of the tubes increase, leading to decreased heat exchange. The amount of by-passed process stream is then reduced, which allows for higher flow of the process stream through the heat exchanging tubes to maintain the required cooling effect. Hence, control of the temperature of the process gas exiting the waste heat boiler is accomplished by varying the flow of the cooled process gas exiting the heat exchanging tubes relative to the flow of the relative hot process gas exiting the by-pass tube.

However, a drawback of the known boilers of the above type is a poor mixing of the cooled process gas and the relative hot process gas exiting the heat exchanging tubes and the by-pass tube respectively of the waste heat boiler.

Experience with known waste heat boiler shows that large temperature variations exist in the process gas downstream of the waste heat boiler. This is problematic as for instance the relative hot part of the downstream process gas can lead to corrosion and the temperature variations may entail temperature tensions.

Examples of known art which have sought to solve the problem of poor mixing are disclosed in EP0357907 which discloses a heat exchanger with heat exchanger pipes which run between two chambers and which are flowed through by a fluid and flowed against by another fluid, and with an overflow pipe through which a changeable partial flow of the fluid can be guided to avoid the heat exchange. The overflow pipe is provided with a valve arrangement for the modification of its flow cross-section. This valve arrangement comprises a valve disc, which closes the overflow pipe in one end position of the valve arrangement, and a valve ring which is flowed through by the fluid leaving the overflow pipe and, in the other end position of the valve arrangement, closes an outlet opening for the fluid issuing from the heat exchanger pipes. In order to guarantee a low-loss and intensive mixing of the partial flows of the fluid with greatly reduced space requirement for the mixing section, the outlet opening is formed in a collecting cone which interacts with the valve ring. The valve ring is provided with a conical outlet area which is provided with a great number of penetration openings and the inclination of which to the longitudinal axis of the heat exchanger corresponds approximately to the inclination of the collecting cone.

Another example is disclosed in WO 2012/041344 which describes a waste heat boiler having heat exchange tubes for indirect heat exchange of a relatively hot process gas and a cooling media, and a by-pass tube for by-passing a part of the process gas; a process gas collector collects and mixes a part of the heat exchanged process gas and at least a part of the by-passed process gas before the mix is lead via a control valve to the process gas outlet of the waste heat boiler together with the rest of the heat exchanged process gas.

Further examples of waste heat boilers are described in U.S. Pat. No. 5,452,686A, US2007125317A, U.S. Pat. No. 4,993,367A, GB1303092A, U.S. Pat. No. 1,918,966A and EP0357907A.

SUMMARY OF THE INVENTION

An object of this invention is to avoid the drawbacks of the known waste heat boilers by providing a boiler of the shell-and-tube heat exchanger type with an improved exit gas mixing.

A further object of this invention is to achieve efficient mixing of the exit process gas from the waste heat boiler within a short mixing length without incurring excessive pressure loss.

According to an embodiment of the invention this is achieved by a waste heat boiler for heat exchanging a relatively hot process gas with a cooling media where the waste heat boiler comprises a shell comprising shell parts, and at least two tube sheets placed in an inlet end and an outlet end of the heat exchange section second shell part, whereby this second shell part and the two tube sheets enclose the heat exchange section of the waste heat boiler. A plurality of heat exchange tubes and at least one process gas by-pass tube are placed in the heat exchange section and are fixed in the first tube sheet near the first end of each tube and fixed in the second tube sheet near the second end of each tube. At least one cooling media inlet and at least one cooling media outlet are located on the waste heat boiler to enable a cooling media to flow into and out of the heat exchange section on the shell side of the tubes. The cooling media is thus enclosed by the second shell part and the first and the second tube sheet. A process gas inlet section is located near the first tube sheet, on the opposite side of the first tube sheet than the cooling media. The inlet section may further be enclosed by a first shell part at the process gas inlet end. A process gas outlet section is located near the second tube sheet also on the opposite side of the second tube sheet than the cooling media. The outlet section may further be enclosed by a third shell part. In the process gas outlet end, a swirl mixer is located. It comprise a first duct in fluid connection with the outlet of the heat exchange tubes and a second duct which is located within the first duct and which is in fluid connection with the outlet of the by-pass tube. The outlet of the first duct is formed by a swirl inducing element and the outlet of the second duct is formed by radial nozzles.

DETAILED DESCRIPTION OF THE INVENTION

Figure 1:
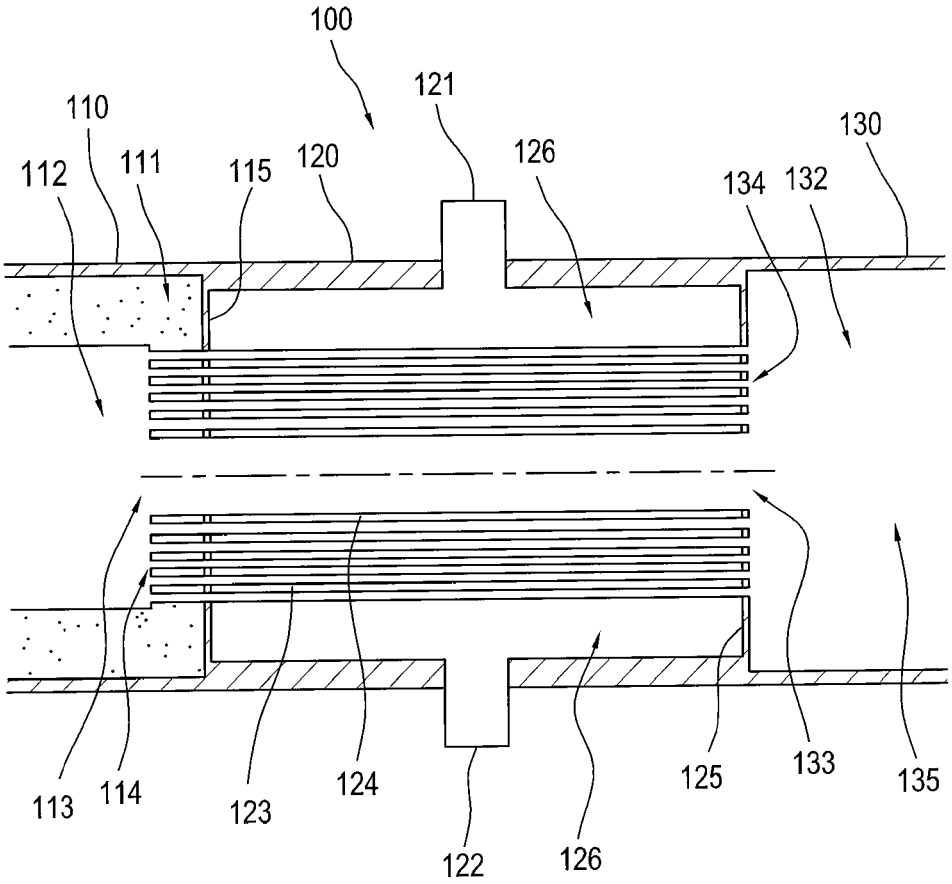
FIG. 1 illustrates a cross-sectional view of a waste heat boiler according to an embodiment of the present invention.

Process gas flows from the first shell part, process gas inlet end, to the heat exchange tube inlets and the by-pass tube inlet, through the heat exchange tubes and the at least one by-pass tube, out of the heat exchange tube outlets and the at least one by-pass process gas outlet to the third shell part, process gas outlet end. A cooling media flows into the heat exchange section via the cooling media inlet and is in contact with the shell side of the heat exchange tubes and can be in contact with the shell side of at least one by-pass tube before the cooling media exits the heat exchange section through the cooling media outlet. The process gas enters the process gas inlet section at a first temperature and exits the heat exchange tubes at a second relatively low temperature. The process gas exiting the by-pass tube has a third temperature which is lower or equal to the first temperature, but higher than the second temperature. Thus the process gas which exits the heat exchange section comprise a part which is cooled (exiting the heat exchange tubes) and a part which is relative hot (exiting the by-pass tube). The cooled process gas exiting the heat exchange tubes flows through the first tube and passes the swirl inducing element located at the end of the first tube relative to the flow direction. As the cooled process gas exits the swirl inducing element it has a swirling motion. The relative hot process gas which exits the by-pass tube flows axially through the second tube and changes flow direction to a radial direction at the end of the second tube where it exits through radial nozzles or aperture(s) located at the end of the second tube relative to the axial flow direction of the process gas, just after the swirl inducing element. The cooled and the relative hot process gas is thus very efficiently mixed as the relatine hot process gas is radially injected into the swirling cooled process gas.

According to a further embodiment of the invention, the swirl mixer further comprises a first valve to control the flow of the cooled process gas exiting the heat exchange tubes. The flow control of the cooled process gas enables the control of the exit temperature of the process gas from the swirl mixer, as it controls the mixture proportion of the cooled process gas and the relative hot process gas. This flow control valve also makes it possible to maintain a constant output temperature of the process gas leaving the swirl mixer regardless of potential increased fouling in the heat exchange tubes which changes their heat exchange ability. In a further embodiment of this invention the first valve is located at the entrance of the first duct relative to the axial flow direction of the process gas. The valve is a sliding valve, and it slides around the second duct.

In an embodiment of the invention, the swirl mixer further comprises a flow straightening element located within the first duct before the swirl inducing element relative to the axial flow direction of the process gas. The element straightens the flow of the cooled process gas before it reaches the swirl inducing element.

An embodiment of the invention further comprises a second valve to control the flow of the relative hot process gas exiting the at least one by-pass tube. The second valve is located in the first part of the second duct relative to the axial flow direction of the process gas.

In an embodiment of the invention, the first and the second ducts are circular tubes which are positioned co-axial to each other. The cooled process gas exiting the heat exchange tubes is thus flowing in the annulus inside the first duct and outside the second duct of the swirl mixer.

In an embodiment of the invention, the first duct is fixed to the shell of the waste heat boiler by means of a further tube sheet. The tube sheet both fix the first duct and ensures that all the cooled process gas exiting the heat exchange tubes flows through the first duct.

The swirl inducing element may in an embodiment of the invention comprise vanes. The vanes are positioned angled relative to the axis of the first duct.

To resist corrosion and metal dusting, the inside wall of the by-pass tube and at least a part of the second duct is in one embodiment of the invention lined with a ceramic liner.

The waste heat boiler according to the invention may be used for a number of media. In an embodiment of the invention, the cooling media can be water or it can be steam. The cooling media can be water when entering the heat exchange section and a part of the water or all of the water can be heated by the indirect heat-exchange with the relative hot process gas such that all or a part of the cooling media exiting the heat exchange section via the cooling media outlet is steam.

In a further embodiment of the invention, the one or more shell part(s) is substantially cylindrical. The cylindrical shape can be advantageous as it is a pressure robust and material saving shape. By substantial is meant any shape which is oblong in one cross sectional view and any shape which is not far from circular in another cross sectional view, such as circular, elliptic, square, pentagonal, hexagonal etc.

In a further embodiment of the invention, a plurality of heat exchange tubes are placed in a substantially circular array in the tube sheets and the by-pass tube or the at least one by-pass tube is placed substantially in the center of the array. By substantially is meant, that the location does not have to be mathematically accurate, the shapes can vary to a large extent as long as consideration to heat-exchange effectiveness and material costs are respected.

In an embodiment of the invention, the waste heat boiler is used in a process plant producing wet sulphuric acid.

1. Waste heat boiler 100 for heat exchanging a relatively hot process gas with a cooling media comprising a shell 110, 120, 130, at least two tube sheets 115, 125,
a plurality of heat exchange tubes 123,
at least one by-pass tube 124,
a heat exchange section enclosed by said shell part and said at least two tube sheets 126,
a process gas inlet section 112,
a process gas outlet section 132,
at least one cooling media inlet 121,
at least one cooling media outlet 122, the relatively hot process gas enters the heat exchange tubes and the at least one by-pass tube in the process gas inlet section, flows through the heat exchange section where at least the process gas flowing in the heat exchange tubes is in indirect heat exchange with the cooling media and exits in the process gas outlet section, wherein said waste heat boiler further comprises a swirl mixer 200 with a first duct 210 in fluid connection with the outlet of the heat exchange tubes 134 and a second duct 220 within the first duct and in fluid connection with the outlet of the by-pass tube 133, the outlet of the first duct is formed by a swirl inducing element 211 and the outlet of the second duct is formed by radial nozzles 221.

2. Waste heat boiler according to feature 1, wherein the swirl mixer further comprises a first valve 212 to control the flow of the cooled process gas exiting the heat exchange tubes.

3. Waste heat boiler according to feature 2, wherein the first valve is located at the entrance of the first duct and is sliding around the second duct.

4. Waste heat boiler according to any of the preceding features, wherein the swirl mixer further comprising a flow straightening element located within the first duct and before the swirl inducing element relative to the axial flow direction of the cooled process gas in the first duct.

5. Waste heat boiler according to any of the preceding features, wherein the swirl mixer further comprises a second valve (222) to control the flow of the relative hot process gas exiting the at least one by-pass tube.

6. Waste heat boiler according to any of the preceding features, wherein the first and the second ducts are circular tubes which are positioned co-axial to each other.

7. Waste heat boiler according to any of the preceding features, wherein the first duct is fixed to the shell 130 by means of a tube sheet 213.

8. Waste heat boiler according to any of the preceding features, wherein the swirl inducing element comprises vanes.

9. Waste heat boiler according to any of the preceding features, wherein the inside wall of the by-pass tube and at least part of the second duct is lined with a ceramic liner.

10. Waste heat boiler according to any of the preceding features, wherein the cooling media is water or steam or both water and steam.

11. Waste heat boiler according to any of the preceding features, wherein said shell has a cylindrical shape and said at least two tube sheets have a circular shape.

POSITION NUMBER OVERVIEW

100 Waste Heat Boiler, WHB
110 First shell part, process gas inlet end
111 Lining
112 Process gas inlet section
113 By-pass process gas inlet
114 Heat exchange tube inlet
115 First tube sheet, process gas inlet end
120 Second shell part, heat exchange section
121 Cooling media inlet
122 Cooling media outlet
123 Heat exchange tube
124 Process gas by-pass tube
125 Second tube sheet, process gas outlet end
126 Heat exchange section
130 Third shell part, process gas outlet end
132 Process gas outlet section
133 By-pass process gas outlet
134 Heat exchange tube outlet
135 mixed process gas outlet
200 Swirl mixer
210 First duct
211 Swirl inducing element
212 First valve
213 Third tube sheet
220 Second duct
221 Radial nozzles
222 Second valve
223 Valve stop FIG. 1 is a cross sectional view of a waste heat boiler 100 according to an embodiment of the invention, without showing the swirl mixer. The waste heat boiler comprises a first shell part, process gas inlet end 110; a second shell part, heat exchange section 120 and a third shell part, process gas outlet end 130; all having a substantially cylindrical shape and substantially the same diameter, but as can be seen on the figure, not necessarily the same material thickness. The material thickness as well as the choice of material can be varied depending on the process conditions.

A first tube sheet, process gas inlet end 115 separates the first shell part from the second shell part. Likewise, a second tube sheet, process gas outlet end 125 separates the secand shell part from the third shell part. Thus the first shell part and the first tube sheet encloses the process gas inlet section 112; the second shell part along with the first and the second tube sheet encloses the heat exchange section 126; and the third shell part and the second tube sheet encloses the process gas outlet section 132. The internal surface of the process gas inlet section can have a liner 111, for instance a ceramic liner to protect the internal surfaces from the high temperatures of the inlet process gas.

The first and the second tube sheets have corresponding bores to accommodate heat exchange tubes 123. The heat exchange tubes stretch at least from the first tube sheet through the heat exchange section to the second tube sheet. The connection between each heat exchange tube and each of the tube sheets are made gas and liquid tight. Each heat exchange tube has a heat exchange tube inlet 114 located in the process gas inlet section and a heat exchange tube outlet 134 located in the process gas outlet section.

The first and the second tube sheets also have at least one corresponding bore for at least one process gas by-pass tube 124. In the embodiment of the invention according to FIG. 1 there is one process gas by-pass tube. The connection between the process gas by-pass tube and the first and the second tube sheet is made gas and liquid tight. The process gas by-pass tube has a by-pass process gas inlet 113 located in the process gas inlet section and a by-pass process gas outlet 133 located in the process gas outlet. The process gas by-pass tube can be provided with a lining (not shown) which can protect the tube from the relative high process gas temperatures and which may also reduce the indirect heat exchange between the cooling media and the by-passed process gas.

In the heat exchange section a cooling media inlet 121 provides fluid connection of a cooling media to the heat exchange section. The at least one cooling media inlet can be located in any position on the second shell part or even on the first or the second tube sheet, as long as fluid connection to the heat exchange section is provided. A location on the shell part of the heat exchange section is shown in FIG. 1. A cooling media outlet 122 located in fluid connection to the heat exchange section provides outlet of the cooling media from the heat exchange section.

Each of the heat exchange tubes and the process gas by-pass tube thus provides fluid connection from the process gas inlet section through the heat exchange section and to the process gas outlet section, thereby enabling the process gas to flow through the heat exchange section without direct contact to the cooling media. The process gas flowing in the heat exchange tubes is in indirect heat-exchange with the cooling media, whereas the part of the process gas which is by-passed, i.e. flowing in the process gas by-pass tube is relative low or substantially no indirect heat-exchange with the cooling media: If the by-pass tube is not lined, the by-passed process gas will have some heat-exchange with the cooling media, but the heat-exchange in the by-pass tube will be relative lower than the heat-exchange in the heat exchange tubes due to the by-pass tube's higher volume to surface ratio. If the by-pass tube is lined, for instance with a ceramic liner, the indirect heat-exchange between the by-passed process gas flowing in the by-pass tube and the cooling media will be relative low or close to zero. In any case, the temperature of the heat-exchanged process gas exiting the heat exchange tube outlets is considerably lower than the temperature of the by-passed process gas exiting the by-pass process gas outlet. A distance after the process gas outlet end, in the mixed process gas outlet 135, the relative hot by-passed procces gas and the cooled process gas is a homogenous mixed gas with even temperature distribution across the cross section of the duct. To shorten this distance a swirl mixer 200 according to FIG. 2 is located in the process gas outlet section.

Figure 2:
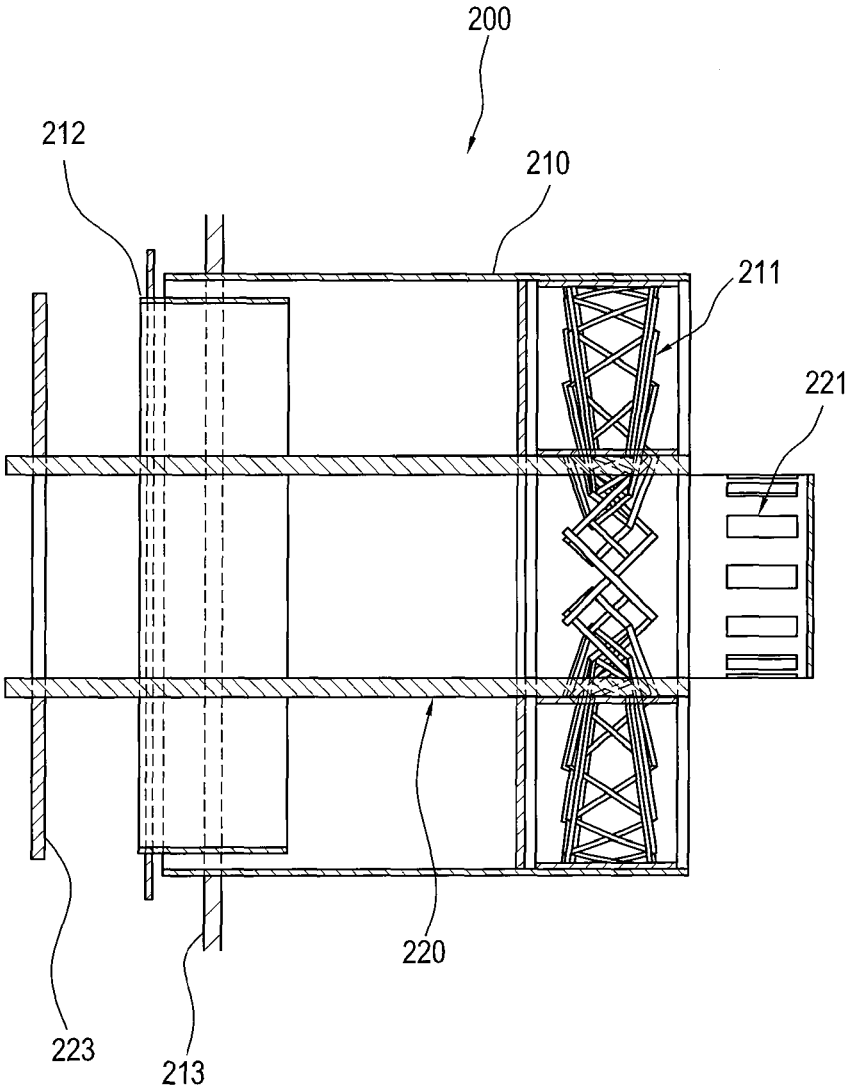
FIG. 2 illustrates a schematic view of a swirl mixer according to an embodiment of the present invention.

Referring to FIG. 2, the swirl mixer 200 comprises a first duct 210 which is in fluid connection with the outlet from the heat exchange tubes. The flow of process gas from the heat exchange tubes through the first duct is controlled by means of a sliding first valve 212. From the first valve through the first duct the cooled process gas flows out of the first duct passing a swirl inducing element 211 in the form of vanes angled relative to the axis of the first duct. The vanes induce a swirling motion to the cooled process gas exiting the first duct. In this embodiment, the first duct is cylindrical. A third tube sheet 213 supports the first duct fully or partially to the third shell part 130 and also prevents the cooled process gas to surpass the first duct.

A second duct 220 is placed concentrically within the first duct and is in fluid connection to the by-pass process gas outlet. The relative hot by-passed process gas is passing through the second duct and tangentially out of the end of the second duct via radial nozzles 221, whereby the relative hot by-passed process gas is efficiently mixed with the swirling cooled process gas. Optionally (not shown on FIG. 2) a second valve 222 may be placed within the second duct to control the by-passed flow of process gas. In the embodiment shown in FIG. 2, a plate acts as a valve stop 223 for the first valve to limit its axial movement.

The invention claimed is:

1. Waste heat boiler for heat exchanging a relatively hot process gas with a cooling media comprising:

a shell, at least two tube sheets located within the shell, a plurality of heat exchange tubes comprising a plurality of inlet and outlet ends that extend through said tube sheets;

a heat exchange section enclosed by a part of said shell and said at least two tube sheets;

a process gas inlet section in fluid connection with said inlet ends;

a process gas outlet section in fluid connection with outlet ends;

at least one by-pass tube extending though the shell comprising an open exit end which is in fluid connection with said gas outlet section;

at least one cooling media inlet in fluid connection with a shell side of said heat exchange section;

at least one cooling media outlet for removing media from said shell side of said heat exchange section, and a mixer section, said mixer section including a first duct and a second duct extending through and beyond the first duct, said first duct having an inlet end in fluid connection with said outlet ends of said plurality of heat exchange tubes and an annular outlet end with internally arranged swirl inducing elements, said second duct in fluid connection with said open exit end of said by-pass tube and having an outlet end formed with radially arranged nozzles to tangentially eject by-passed process gases into the path of process gas emanating from the swirl elements, the mixer section including a first valve to control the flow of process gas exiting the heat exchange tubes, wherein the first valve is located at the entrance of the first duct and slides around the second duct.

2. Waste heat boiler according to claim 1, wherein the swirl mixer further comprising a flow straightening element located within the first duct and before the swirl inducing element relative to the axial flow direction of the cooled process gas in the first duct.

3. Waste heat boiler according to claim 1, wherein the swirl mixer further comprises a second valve to control the flow of the relative hot process gas exiting the at least one by-pass tube.

4. Waste heat boiler according to claim 1, wherein the first duct is fixed to the shell by means of a tube sheet.

5. Waste heat boiler according to claim 1, wherein the swirl inducing elements comprise vanes.

6. Waste heat boiler according to claim 1, wherein the inside wall of the by-pass tube and at least part of the second duct is lined with a ceramic liner.

7. Waste heat boiler according to claim 1, wherein the cooling media is water or steam or both water and steam.

8. Waste heat boiler according to claim 1, wherein said shell has a cylindrical shape and said at least two tube sheets have a circular shape.

* * * * *